US005088906A

United States Patent [19]

Richardson, Jr.

[11] Patent Number: 5,088,906

[45] Date of Patent: Feb. 18, 1992

[54] AXIALLY FLOATING SCROLL MEMBER ASSEMBLY

[75] Inventor: Hubert Richardson, Jr., Brooklyn, Mich.

[73] Assignee: Tecumseh Products Company, Tecumseh, Mich.

[21] Appl. No.: 650,055

[22] Filed: Feb. 4, 1991

[51] Int. Cl.[5] ..... F04C 18/04; F04C 27/00

[52] U.S. Cl. ..... 418/55.2; 418/55.4; 418/55.5; 418/55.6; 418/57

[58] Field of Search ..... 418/55.2, 55.4, 55.5, 418/55.6, 57

[56] References Cited

U.S. PATENT DOCUMENTS

| | | | |
|---|---|---|---|
| 3,874,827 | 4/1975 | Young | 418/55.5 |
| 3,924,977 | 12/1975 | McCullough | 418/55.5 |
| 4,300,875 | 11/1981 | Fischer et al. | 418/57 |
| 4,365,941 | 12/1982 | Tojo et al. | 417/372 |
| 4,600,369 | 7/1986 | Blain | 418/55.5 |
| 4,611,975 | 9/1986 | Blain | 418/5 |
| 4,708,607 | 11/1987 | Hayano et al. | 418/55.5 |
| 4,743,181 | 5/1988 | Murayama et al. | 418/57 |
| 4,767,293 | 8/1988 | Caillat et al. | 418/57 |

FOREIGN PATENT DOCUMENTS

| | | | |
|---|---|---|---|
| 55-46046 | 3/1980 | Japan | 418/55.5 |
| 59-79091 | 5/1984 | Japan | 418/57 |
| 61-8407 | 1/1986 | Japan . | |

*Primary Examiner*—John J. Vrablik
*Attorney, Agent, or Firm*—Baker & Daniels

[57] ABSTRACT

A floating scroll assembly of a hermetic scroll-type compressor including, a fixed scroll frame, a fixed scroll plate, connecting pins coupling the plate and frame together in a manner permitting axial separation, an orbiting scroll plate, a drive plate, connecting pins coupling the orbiting plate and drive plate together in a manner permitting axial separation, and seals unattachedly retained intermediate the scroll frame and fixed scroll plate and intermediate the drive plate and orbiting scroll plate by grooves in the scroll plates. The fixed and orbiting scroll assemblies are forced axially toward one another by exposure of their back surfaces to a combination of refrigerant at suction pressure and refrigerant and oil at discharge pressure. The seals extend out of the grooves to slidingly seal upon compressor operation. Regions on the scroll plates exposed to discharge pressure are substantially the same size.

20 Claims, 3 Drawing Sheets

AXIALLY FLOATING SCROLL MEMBER ASSEMBLY

BACKGROUND OF THE INVENTION

The present invention relates generally to a hermetic scroll-type compressor and, more particularly, to such a compressor having fixed and orbiting scroll members, wherein a compliance mechanism acts to bias the fixed and orbiting scroll members toward one another for proper mating and sealing therebetween.

A typical scroll compressor comprises two facing scroll members, each having an involute wrap, wherein the respective wraps interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

Leakage between compression pockets of a scroll compressor may also occur at those locations where the wrap walls sealingly contact each other to define the moving compression pockets. Specifically, the pressure of the compressed refrigerant in the compression pockets, together with manufacturing tolerances of the component parts, may cause slight radial separation of the scroll members and result in the aforementioned leakage.

Efforts to counteract the separating forces applied to the scroll members during compressor operation, and thereby minimize the aforementioned leakages, have resulted in the development of several prior art compliance schemes. With respect to axial compliance mechanisms, the scroll members may be preloaded axially toward each other with a force sufficient to resist the dynamic separating force. However, this approach results in high initial frictional forces between the scroll members and/or bearings when the compressor is at rest, thereby causing difficulty during compressor startup. Another prior art approach involves assuring close manufacturing tolerances for component parts and having the separating force borne by a thrust bearing. This approach not only requires an expensive thrust bearing, but also involves high manufacturing costs in maintaining close machining tolerances.

In a compressor having a pressurized, or "high side", housing, discharge pressure may be used on the back side of the fixed or orbiting scroll member to create a force to oppose the separating force. In such an arrangement, it is difficult to control the magnitude of the resulting force and excessive friction and power losses may result. One solution has been to use a combination of gaseous refrigerant at suction pressure and gaseous refrigerant at discharge pressure, and expose them to respective areas on the backside of an axially movable fixed or orbiting scroll member. In such compressor designs, various seal means have been utilized to separate the respective gaseous pressure regions and to compensate for axial movement of the scroll member.

In another type of axial compliance mechanism, an intermediate pressure chamber is provided behind the orbiting scroll member, whereby the intermediate pressure creates an upward force to oppose the separating force. Such a design recognizes the fact that only suction pressure behind the orbiting scroll member is insufficient to oppose the separating force, while discharge pressure behind the orbiting scroll member results in too great an upward force and may cause rapid wear of the scroll wraps and faces. However, establishing an intermediate pressure between suction pressure and discharge pressure requires that an intentional leak be introduced between an intermediate pressure pocket and a discharge pressure region. Such a leak results in less efficient operating conditions for the compressor.

The present invention is directed to overcoming the aforementioned problems associated with scroll-type compressors, wherein it is desired to provide axial forces on the mating scroll members to facilitate sealing and prevent leakage.

SUMMARY OF THE INVENTION

The present invention overcomes the disadvantages of the above-described prior art scroll-type compressors by providing an improved axial compliance mechanism to resist the tendency of the scroll members to axially separate during compressor operation, wherein the fixed and orbiting scroll members are both axially movable and are biased toward one another by exposure of their respective back surfaces to a combination of discharge pressure and suction pressure.

Generally, the invention provides an axially floating scroll assembly for use as the fluid displacement apparatus in a scroll-type compressor. More specifically, the floating scroll assembly includes a fixed scroll assembly and an orbiting scroll assembly. The fixed scroll assembly includes a scroll plate having a back surface and a front surface from which an involute wrap downwardly extends. A separate scroll frame includes an attaching surface. The back surface of the fixed scroll plate is coupled to the attaching surface of the frame so as to permit axial movement of the fixed scroll plate and frame relative one another. A chamber is defined intermediate the scroll plate and the frame, for causing axial separation of the scroll plate and frame relative one another in response to pressurized fluid being introduced into the chamber.

The orbiting scroll assembly includes an orbiting scroll plate having a hind surface and a face surface from which an involute wrap upwardly extends. A separate drive plate includes a mounting surface and a hub surface. The hind surface of the orbiting scroll plate is coupled to the mounting surface of the drive plate so as to permit axial movement of the orbiting scroll plate and drive plate relative one another. A substantially sealed chamber is defined intermediate the orbiting scroll plate and the drive plate, for causing axial separation of the scroll plate and drive plate relative one another in response to pressurized oil being introduced into the chamber.

One advantage of the scroll compressor of the present invention is the provision of a compliance mechanism that is capable of operating in the presence of, and compensating for, axial space resulting from axial movement of the fixed and orbiting scroll members toward one another. Specifically, axial movement of both scroll members permits the axial space to be taken up by the respective seals of both scroll members, thereby lowering the cost to manufacture the compressor by permitting larger machining tolerances for the component parts and stack-up tolerances during assembly.

Another advantage of the scroll compressor of the present invention, according to one form thereof, is that of a floating fixed and orbiting scroll member pair having balanced axial loading, thereby decreasing loading on compressor frame members.

A further advantage of the scroll compressor of the present invention is the provision of a simple, reliable, inexpensive, and easily manufactured compliance mechanism for producing a substantial force on the fixed scroll plate and orbiting scroll plate toward each other.

The invention, in one form thereof, provides a floating scroll assembly for use as the displacement apparatus in a scroll-type compressor. The floating scroll assembly includes a fixed scroll member assembly and an orbiting scroll member assembly.

The fixed scroll member assembly includes a fixed scroll plate with an involute wrap attached thereon, and a fixed scroll frame with an attaching surface. Spaced along the back surface of the fixed scroll plate is a mechanism to couple the scroll plate and frame. Specifically, there is at least one axial bore in the back surface of the scroll plate, and a corresponding axial bore in the attaching surface of the scroll frame. Each one of the axial bores in the scroll plate is axially aligned with a respective one of the axial bores in the scroll frame. A connecting pin is received within each respective bore in the scroll plate and a corresponding respective bore in the scroll frame.

The orbiting scroll member assembly includes an orbiting scroll plate with an involute wrap attached thereon, and a drive plate with a mounting surface and hub surface. Spaced along the hind surface of the scroll plate is a mechanism to couple the orbiting scroll plate and drive plate. Specifically, there is a plurality of axial bores in the hind surface of the orbiting scroll plate, and a corresponding plurality of axial bores in the mounting surface of the drive plate. Each one of the plurality of axial bores in the scroll plate is axially aligned with a respective one of the plurality of axial bores in the drive plate. A plurality of connecting pins are each received within a respective bore in the scroll plate and a corresponding respective bore in the drive plate.

In accord with one aspect of the invention, a mechanism for sealing between the fixed scroll plate and frame is provided. Specifically, the sealing mechanism includes an annular seal groove on the back surface of the fixed scroll plate and an annular seal element unattachedly retained therein. This seal element permits fluid at compressor discharge pressure to substantially fill the space between the fixed scroll plate and fixed scroll frame. Consequently, the fixed scroll plate and fixed frame are forced axially apart, permitting axial compliance of the fixed scroll plate with the orbiting scroll member assembly.

According to a further aspect of the invention, a mechanism for sealing between the orbiting scroll plate and the drive plate is provided. Specifically, the sealing mechanism includes an annular seal groove on the hind surface of the orbiting scroll plate and an annular seal element unattachedly retained therein. This seal element permits oil at compressor discharge pressure to substantially fill the space between the orbiting scroll plate and drive plate. Consequently, the orbiting scroll plate and drive plate are forced axially apart, permitting axial compliance of the orbiting scroll plate with the fixed scroll member assembly.

According to another aspect of the invention, the respective areas sealed off by the annular seal on the orbiting scroll plate and the annular seal on the fixed scroll plate are substantially the same. This ensures that substantially the same pressure is placed on each scroll plate, thereby axially balancing the net axial force on the floating scroll assembly.

DESCRIPTION OF THE PREFERRED EMBODIMENT

Figure 1:
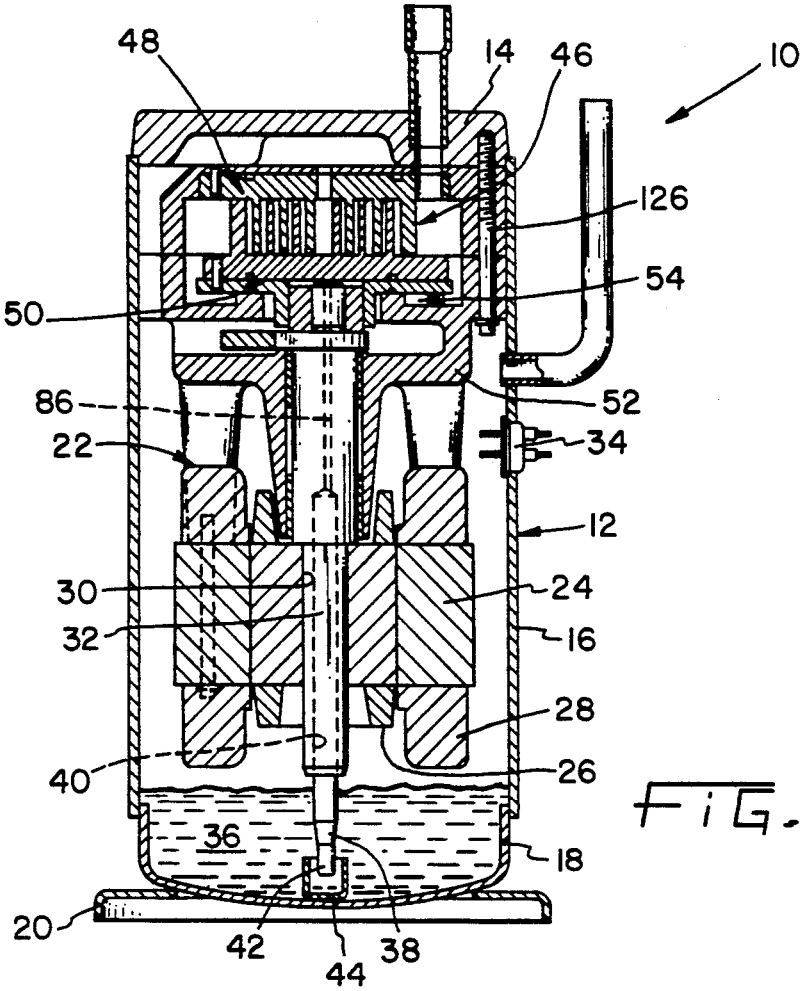
FIG. 1 is a longitudinal sectional view of a compressor of the type to which the present invention pertains.
Figure 2:
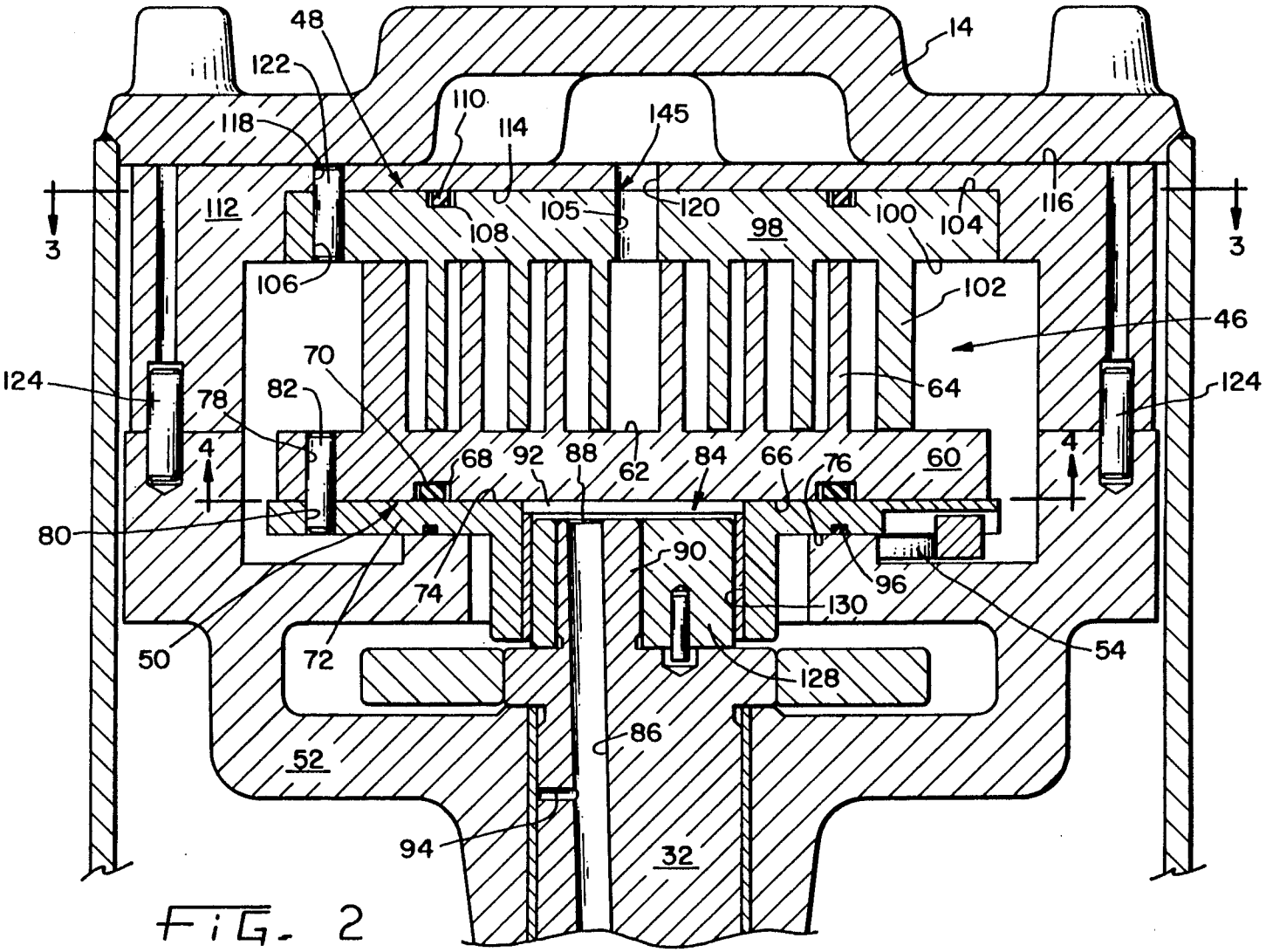
FIG. 2 is an enlarged fragmentary sectional view of the compressor of FIG. 1, particularly showing the floating scroll assembly of the present invention.

Referring now to FIGS. 1 and 2, there is shown a compressor 10 having a housing generally designated at 12. The housing has a top cover plate 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position.

Located within hermetically sealed housing 12 is an electric motor generally designated at 22, having a stator 24 and a rotor 26. Stator 24 is provided with windings 28. Rotor 26 has a central aperture 30 provided therein into which is secured a crankshaft 32 by an interference fit. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extend downwardly into the open end of a cylindrical oil cup 44, which provides a quiet zone from which high quality, non-agitated oil is drawn.

A floating scroll compressor mechanism 46 is enclosed within housing 12, and generally comprises a fixed scroll member assembly 48 and an orbiting scroll member assembly 50, which are capable of moving axially relative a main bearing frame member 52. Orbiting scroll assembly 50 is prevented from rotating about its own axis by means of a conventional Oldham ring assembly, comprising an Oldham ring 54, and orthogonally arranged Oldham key pairs associated with orbiting scroll assembly 50 and frame member 52, respectively. The floating scroll pair of fixed scroll assembly 48 and orbiting scroll assembly 50, in accordance with the present invention, will be more fully described hereinafter.

Figure 4:
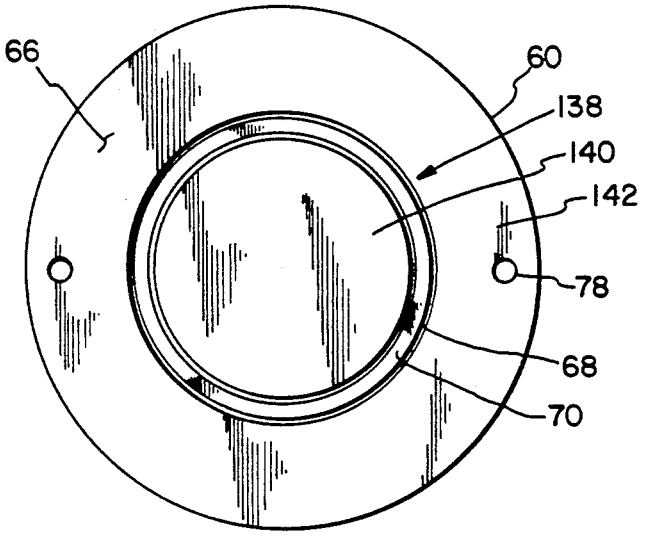
FIG. 4 is an enlarged transverse sectional view of the orbiting scroll member assembly of the compressor of FIG. 1, taken along the line 4—4 in FIG. 2 and viewed in the direction of the arrows, particularly showing the hind side of the orbiting scroll plate.

Referring to FIGS. 2 and 4, orbiting scroll assembly 50 comprises a generally flat orbiting scroll plate 60, including a face surface 62 having an involute wrap 64 thereon, and a hind surface 66. Hind surface 66 includes an annular seal groove 68 within which an annular seal element 70 is partially disposed. The orbiting scroll assembly also includes a drive plate 72 having a top mounting surface 74 and a bottom hub surface 76.

Hind surface 66 of scroll plate 60 has a plurality, and preferably a pair, of axial holes 78, while mounting surface 74 of drive plate 72 has a corresponding number of axial holes 80. Orbiting scroll plate 60 and drive plate 72 are coupled together by a plurality of connecting pins 82 received within respective axial holes 78 and 80.

The connecting pins 82 are slidingly received in either orbiting scroll plate 60 or drive plate 72, to allow axial movement of orbiting scroll plate 60 relative to drive plate 72. In the disclosed embodiment of the invention, a pair of connecting pins 82 have one of their ends press fit into a corresponding pair of axial holes 80 at diametrically opposed locations on drive plate 72. The other ends of the pins 82 extend upwardly from mounting surface 72 and are slidingly received into a corresponding pair of axial holes 78.

A lubrication system for compressor 10 provides lubricating oil from oil sump 36 to floating scroll mechanism 46, crankshaft 32, and crank mechanism 84. Specifically, an oil passageway 86 is provided in crankshaft 32, which communicates with tube 38 and extends upwardly through crankshaft 32 to an opening 88 on the top of an eccentric crankpin 90 at the top of crankshaft 32. Oil passageway 86 permits oil to fill a chamber 92 formed by annular seal 70, hind surface 66, and mounting surface 74. A radial oil passage 94 delivers oil from oil passage 86 to the bearing portion of main frame 52. An annular seal 96 is operably disposed between main bearing frame member 52 and orbiting scroll assembly 50, thereby sealing between a radially inner discharge pressure and a radially outer suction pressure.

Figure 3:
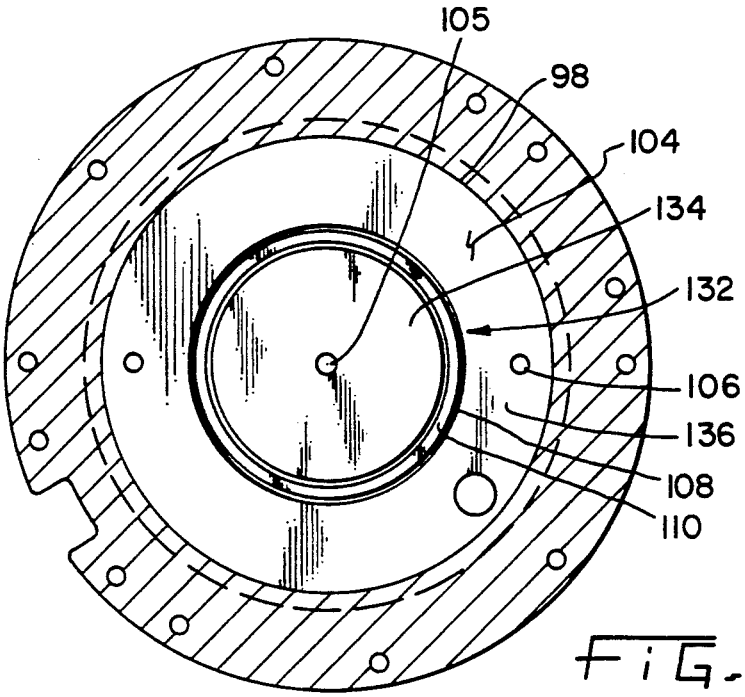
FIG. 3 is an enlarged transverse sectional view of the compressor of FIG. 1, taken along the line 3—3 in FIG. 2 and viewed in the direction of the arrows, particularly showing the back surface of the fixed scroll plate and the surrounded frame member.

Referring to FIGS. 2 and 3, fixed scroll assembly 48 comprises a generally flat scroll plate 98, including a front surface 100 having an involute wrap 102 thereon, and a back surface 104. Back surface 104 includes an annular seal groove 108 within which an annular seal element 110 is partially disposed. Back surface 104 also includes at least one, and preferably a pair, of axial holes 106, as well as a port 105 through which compressed fluid is discharged from the compression pockets.

Fixed scroll assembly 48 also includes a fixed scroll frame 112 having an attaching surface 114 and an outside surface 116. Attaching surface 114 includes axial holes 118 corresponding to axial holes 106 of back surface 104. Fixed scroll frame 112 also has an opening 120 to allow pressurized fluid to flow into housing 12 from discharge port 105 of fixed scroll plate 105. Fixed scroll plate 98 and fixed scroll frame 112 are coupled together by connecting pins 122 received within respective axial holes 106 and 118.

The connecting pins 122 are slidingly received in either the scroll plate 98 or scroll frame 112, to allow axial movement of scroll plate 98 relative to scroll frame 112. In the disclosed embodiments of the invention, a pair of connecting pins 122 have one of their ends press fit into a corresponding pair of axial holes 118 at diametrically opposed locations on scroll frame 112. The other ends of the pins extend downwardly from attaching surface 114 and are slidingly received into a corresponding pair of axial holes 106. Connecting pins 122 prevent rotation of the scroll plate 98 relative scroll frame 112, as well as permit axial movement relative thereto. Scroll frame 112 is aligned with main bearing frame member 52 by a number of aligning pins 124, and is attached to main bearing frame member 52 and top cover plate 14 by a plurality of bolts 126.

Floating scroll mechanism 46 is assembled such that orbiting scroll wrap 64 interfits with the fixed scroll wrap 102 to permit compression of refrigerant when orbiting scroll assembly 50 is orbited relative to fixed scroll assembly 48. Moreover, the floating scroll pair is capable of moving axially, inasmuch as the respective scroll plates of each scroll assembly is designed to move axially from its respective mounting or attaching surface.

Radial compliance in the floating scroll mechanism 46, in accordance with the embodiment of FIG. 2, is achieved through the use of an eccentric crank mechanism 84 situated on the top of crankshaft 32. Crank mechanism 84 comprises a conventional swing-link mechanism including a cylindrical roller 128 and eccentric crankpin 90, whereby roller 128 is eccentrically journalled about eccentric crankpin 90. As previously described, drive plate 72 of orbiting scroll assembly 50 includes a hub surface 76 that defines a cylindrical well 130 into which roller 128 is received. This arrangement allows the orbiting scroll assembly 50 to be moved into radial compliance with the fixed scroll member 48.

The axial compliance mechanism of compressor 10, in accordance with the floating scroll assembly of the present invention, will now be further described with reference to FIGS. 3–8. Generally, respective circular central portions of back surface 104 of fixed scroll plate 98 and hind surface 66 of orbiting scroll plate 60 are exposed to discharge pressure, thereby providing a substantially constant force distribution forcing the fixed and orbiting scroll plates toward one another. More specifically, a first annular seal mechanism 132 cooperates between back surface 104 and adjacent scroll frame 112 in order to sealingly separate between a radially inner portion 134 and a radially outer portion 136 of back surface 104, which are exposed to discharge pressure and suction pressure, respectively. A second annular seal mechanism 138 cooperates between hind surface 66 and adjacent mounting surface 74 in order to sealingly separate between a radially inner portion 140 and a radially outer portion 142 of hind surface 66, which are exposed to discharge pressure and suction pressure, respectively.

Figure 5:
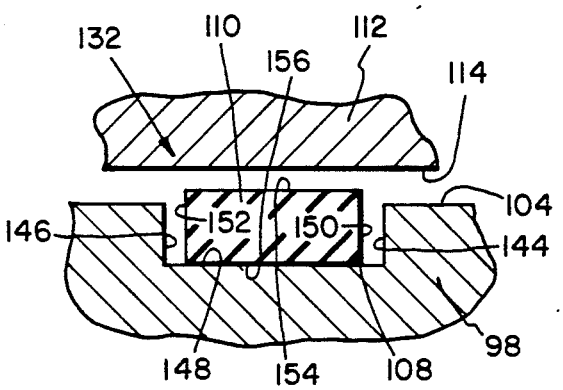
FIG. 5 is an enlarged fragmentary sectional view of the annular seal element of the fixed scroll member assembly of the compressor of FIG. 1, shown in a non-actuated state.
Figure 7:
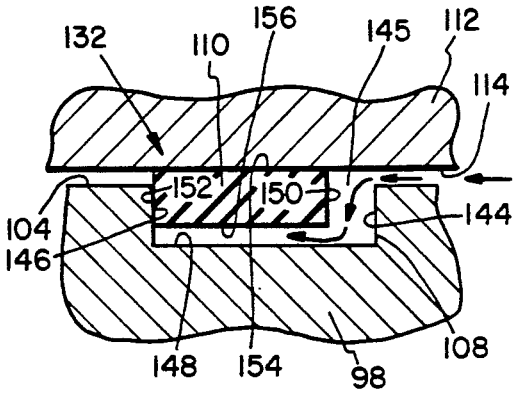
FIG. 7 is an enlarged fragmentary sectional view of the annular seal element of the fixed scroll member assembly of the compressor of FIG. 1, shown in an actuated state.

In accordance with the disclosed embodiment, seal mechanism 132 comprises an annular elastomeric seal element 110 unattachedly received within seal groove 108. In the preferred embodiment, the radial thickness of seal element 110 is less than the radial width of seal groove 108, as best shown in FIGS. 5 and 7. Referring to FIG. 5, annular seal groove 108 includes a radially inner wall 144, a radially outer wall 146, and a bottom wall 148 extending therebetween. Annular seal element 110 is generally rectangular and includes a radially inner surface 150, a radially outer surface 152, a top surface 154, and a bottom surface 156. In its unactuated condition shown in FIG. 5, seal element 110 has a diameter less than the diameter of outer wall 146, whereby outer surface 152 is slightly spaced from outer wall 146. Also, top surface 154 is initially spaced from attaching surface 114 due to the influence of gravitational force on fixed scroll plate 98.

Figure 6:
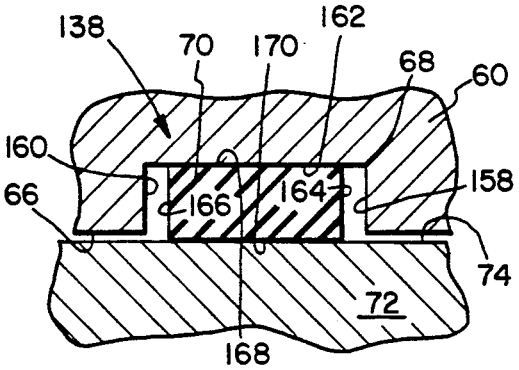
FIG. 6 is an enlarged fragmentary sectional view of the annular seal element of the orbiting scroll member assembly of the compressor of FIG. 1, shown in a non-actuated state.
Figure 8:
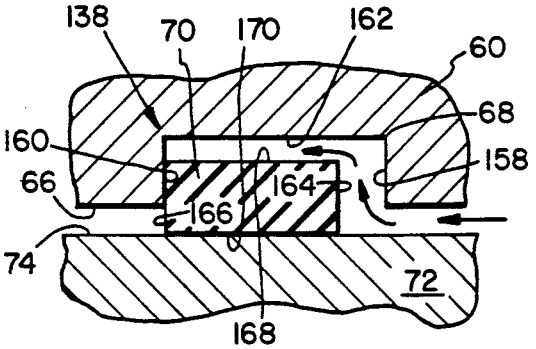
FIG. 8 is an enlarged fragmentary sectional view of the annular seal element of the orbiting scroll member assembly of the compressor of FIG. 1, shown in an actuated state.

Likewise, seal mechanism 138 comprises an annular elastomeric seal element 70 unattachedly received within seal groove 68. Annular seal groove 68 on orbiting scroll plate 60 encircles approximately the same area as annular seal groove 108 on fixed scroll plate 98, thereby ensuring balanced axial force on the floating scroll assembly, as previously described. Referring to FIGS. 6 and 8, the radial thickness of seal element 70 is less than the radial width of seal groove 68, as shown in FIGS. 6 and 8. Referring to FIG. 6, annular seal groove 68 includes a radially inner wall 158, a radially outer wall 160, and a bottom wall 162 extending therebetween. Annular seal element 70 is generally rectangular and includes a radially inner surface 164, a radially outer surface 166, a top surface 168, and a bottom surface 170. In its unactuated condition shown in FIG. 6, seal element 70 has a diameter less than the diameter of outer wall 160, whereby outer surface 166 is slightly spaced from outer wall 160. Also, seal element 70 initially supports the combined weight of fixed scroll plate 98 and orbiting scroll plate 60, being acted upon by gravity.

Axial compliance of floating scroll assembly 46 is initiated as refrigerant fluid is compressed and discharged through port 105 and opening 120, whereupon it enters and causes pressurization of the interior of housing 12. Initially, the floating scroll pair will begin moving axially upwardly, away from the thrust surface of frame member 52. At the same time, orbiting scroll plate 60 and fixed scroll plate 98 will experience a separating force urging them toward drive plate 72 and fixed scroll frame 112, respectively.

The compressed refrigerant exiting through port 105 and opening 120 enters a chamber 145 formed by attaching surface 114, back surface 104, and seal element 110, as shown in FIGS. 2 and 7. The introduction of pressurized refrigerant causes seal element 110 to expand radially outwardly and fixed scroll plate 98 to move axially downwardly away from frame 112, guided by connecting pins 122. As a result of the axial movement of fixed scroll plate 98, increased space is created between back surface 104 and frame 112. Seal element 110 moves telescopingly upwardly toward frame 112 under the influence of a venturi effect created by the initial fluid flow between top surface 154 and frame 112. Consequently, refrigerant at discharge pressure occupies the space between bottom wall 148 and bottom surface 156. From the foregoing, it will be appreciated that refrigerant at discharge pressure acting on bottom surface 156 and inner surface 150 of seal element 110 creates a force distribution on the seal element 110 that urges it axially upwardly toward attaching surface 114 and radially outwardly toward outer wall 146 to seal thereagainst.

During compressor operation, oil pickup tube 38 draws lubricating oil at discharge pressure from oil sump 36 and causes oil to move upwardly through oil passageway 86. Referring to FIG. 2, oil pumped through opening 88 fills a substantially sealed chamber 92 defined by hind surface 66 of scroll plate 60, mounting surface 74 of drive plate 72, seal element 70 disposed therebetween, and the top surface of crank mechanism 84 within well 130.

The presence of oil at discharge pressure within chamber 92 causes orbiting scroll plate 60 to move axially away from drive plate 72, guided by connecting pins 82. The oil occupies the volume shown radially inwardly of seal element 70 in FIG. 8, thereby causing seal element 70 to expand radially outwardly and orbiting scroll plate 60 to move further axially upwardly away from drive plate 72, as shown in FIG. 8. As a result of the axial movement of orbiting scroll plate 60, increased space is created between hind surface 66 and drive plate 72. Seal element 70 moves telescopingly downward toward drive plate 72 under the influence of gravity and/or a venturi effect created by the initial fluid flow between bottom surface 170 and drive plate 72. Consequently, oil at discharge pressure occupies the space between bottom wall 162 and top surface 168. From the foregoing, it will be appreciated that oil at discharge pressure acting on top surface 168 and inner surface 164 of seal element 70 creates a force distribution on the seal element 70 that urges it axially downwardly toward mounting surface 74 and radially outwardly toward outer wall 160 to seal thereagainst.

The provision of a stationary surface against which the seal elements 70, and 110 slidingly seal exhibits several noteworthy advantages. For instance, relative movement between the seal elements and sealing surfaces is minimized, thereby reducing frictional forces and increasing seal life. Additionally, leakage past the seal is more effectively controlled. It should also be noted that in the seal configurations described herein, leakage is minimized by the absence of seal mounting apparatus and complex multi-piece seal configurations.

The annular seal elements disclosed herein is preferably composed of a Teflon material. More specifically, a glass-filled Teflon, or a mixture of Teflon, Carbon, and Ryton is preferred in order to provide the seal element with the necessary rigidity to resist extruding into clearances due to pressure differentials. Furthermore, the surfaces against which the Teflon seal contacts are preferably cast iron. While the seal grooves have been shown as being in a particular one of two adjacent surfaces, it is contemplated that the seal groove could alternatively be formed in the other surface.

It is believed that the provision of a floating scroll set, wherein fixed and orbiting scroll plate members are axially movable with respect to a fixed frame and an orbiting drive plate, permits easier compensation for the axial space created by compliance movement and machining and assembly tolerances. Furthermore, it is contemplated that by providing clearance between the connecting pins and the axial holes in the scroll plates into which they are received, a slight tilting of the floating scroll pair may be accomplished, thereby helping to maintain sealing despite overturning moments imparted on the orbiting scroll assembly by the drive configuration.

It will be appreciated that the foregoing description of various embodiments of the invention is presented by way of illustration only and not by way of any limitation, and that various alternatives and modifications may be made to the illustrated embodiment without departing from the spirit and scope of the invention.

What is claimed is:

1. A floating scroll assembly for use as a fluid displacement apparatus in a hermetic scroll-type compressor, comprising:

a hermetically sealed housing;

a fixed scroll frame in said housing including an attaching surface;

a drive plate including a mounting surface axially opposing said attaching surface;

a fixed scroll plate coupled to said fixed scroll frame in a manner permitting axial movement of the entire fixed scroll plate relative to said attaching surface, including a back surface facing said attaching surface and an opposite front surface having an involute wrap thereon;

an orbiting scroll plate coupled to said mounting surface, including a hind surface facing said mounting surface and an opposite face surface having an involute wrap thereon, said involute wrap of said fixed scroll plate and said involute wrap of said orbiting scroll plate being operably intermeshed axially intermediate said fixed scroll frame and said drive plate; and axial compliance means between said attaching surface and said back surface and between said mounting surface and said hind surface for biasing said fixed scroll plate and said orbiting scroll plate toward one another to form an axially compliant scroll assembly that is axially movable relative said fixed scroll frame and said drive plate.

2. A floating scroll assembly for use as a fluid displacement apparatus in a hermetic scroll-type compressor, comprising:

a fixed scroll frame including an attaching surface;

a drive plate including a mounting surface axially opposing said attaching surface;

a fixed scroll plate coupled to said fixed scroll frame, including a back surface facing said attaching surface and an opposite front surface having an involute wrap thereon;

an orbiting scroll plate coupled to said mounting surface, including a hind surface facing said mounting surface and an opposite face surface having an involute wrap thereon, said involute wrap of said fixed scroll plate and said involute wrap of said orbiting scroll plate being operably intermeshed axially intermediate said fixed scroll frame and said drive plate; and axial compliance means for biasing said fixed scroll plate and said orbiting scroll plate toward one another to form an axially compliant scroll assembly that is axially movable relative said fixed scroll frame and said drive plate, said axial compliance means comprising;

a first coupling means for coupling said fixed scroll plate to said fixed scroll frame, said first coupling means permitting axial movement of said fixed scroll plate relative to said fixed scroll frame;

a fixed seal element unattachedly disposed intermediate said back surface and said attaching surface, said seal element defining a first chamber intermediate said back surface and said attaching surface and permitting axial separation of said fixed scroll plate and said fixed scroll frame relative one another in response to introduction of a pressurized fluid in said first chamber;

second coupling means for coupling said orbiting scroll plate to said drive plate, said second coupling means permitting axial movement of said orbitng scroll plate relative to said drive plate;

a second seal element unattachedly disposed intermediate said hind surface and said mounting surface, said seal element defining a substantially sealed second chamber intermediate said hind surface and said drive surface and permitting axial separation of said orbiting scroll plate and said drive plate relative one another in response to introduction of a pressurized fluid in said second chamber;

first passage means for introducing a pressurized fluid within said first chamber; and second passage means for introducing a pressurized fluid within said second chamber.

3. The floating scroll assembly of claim 2 in combination with a hermetic scroll compressor apparatus including a scroll compressor mechanism and an oil sump within a hermetically sealed housing at discharge pressure, in which:

said second passage means is in fluid communication with said oil sump, whereby oil at discharge pressure is introduced within said second chamber.

4. The floating scroll assembly of claim 2 in which:

said first coupling means includes at least one connecting pin having one end received within an axial hole in said fixed scroll frame and another end received within a corresponding axially aligned hole in said fixed scroll plate, at least one of said connecting pin ends being slidably received within its respective hole to permit axial movement of said fixed scroll plate relative said fixed scroll frame.

5. The floating scroll assembly of claim 4 in which:

one of said connecting pin ends is received within its corresponding hole by an interference fit and said other of said connecting pin ends is slidably received within its corresponding hole.

6. The floating scroll assembly of claim 2 in which:

said back surface of said fixed scroll plate includes a first seal groove in which said first seal element is partially disposed.

7. The floating scroll assembly of claim 6 in which:

said first seal element and said first seal groove are generally annular, and said first seal element is unattachedly retained within said first seal groove and telescopingly extends axially from said first seal groove toward said attaching surface of said fixed scroll frame to slidingly seal thereagainst.

8. The floating scroll assembly of claim 2 in which:

said first coupling means comprises anti-rotation means for preventing rotation of said fixed scroll plate relative to said fixed scroll frame.

9. The floating scroll assembly of claim 8 in which:
said anti-rotation means comprises interference between said fixed scroll plate and said fixed scroll frame in response to attempted rotation of said fixed scroll plate relative said fixed scroll frame.

10. The floating scroll assembly of claim 2 in which:
said second coupling means includes a plurality of connecting pins, each connecting pin having a first end received within a corresponding hole in said drive plate and a second end received within a corresponding hole in said orbiting scroll plate, at least one of said first and second ends being slidably received within its corresponding hole to permit axial movement of said orbiting scroll plate relative said drive plate.

11. The floating scroll assembly of claim 10 in which:
one of said first and second ends of each of said plurality of connecting pins is received within its corresponding hole by an interference fit and the other of said first and second ends is slidably received within its corresponding hole.

12. The floating scroll assembly of claim 10 in which:
said second coupling means comprises a pair of connecting pins received within corresponding holes at diametrically opposed locations of said orbiting scroll plate and said drive plate.

13. The floating scroll assembly of claim 2 in which:
said hind surface of said orbiting scroll plate includes a second seal groove in which said second seal element is partially disposed.

14. The floating scroll assembly of claim 13 in which:
said second seal element and said second seal groove are generally annular, and said second seal element is unattachedly retained within said second seal groove and telescopingly extends axially from said second seal groove toward said mounting surface of said drive plate to slidingly seal thereagainst.

15. The floating scroll assembly of claim 2 in which:
said first chamber and said second chamber are exposed to substantially equal areas on said back surface of said fixed scroll plate and said hind surface of said orbiting scroll plate, respectively, thereby resulting in substantially equal compliance forces applied to said fixed scroll plate and said orbiting scroll plate.

16. A floating scroll assembly for use as a fluid displacement apparatus in a hermetic scroll-type compressor, comprising:
a fixed scroll frame including an attaching surface;
a drive plate including a mounting surface axially opposing said attaching surface;
a fixed scroll plate coupled to said fixed scroll frame, including a back surface facing said attaching surface and an opposite front surface having an involute wrap thereon;
an orbiting scroll plate coupled to said mounting surface, including a hind surface facing said mounting surface and an opposite face surface having an involute wrap thereon, said involute wrap of said fixed scroll plate and said involute wrap of said orbiting scroll plate being operably intermeshed axially intermediate said fixed scroll frame and said drive plate;
at least one connecting pin having one end received into an axial hole formed in said fixed scroll frame and opening onto said attaching surface, and another end received within an axial hole formed in said fixed scroll plate and opening onto said back surface, at least one end of said connecting pin being slidably received within its corresponding hole to permit axial movement of said fixed scroll plate relative said fixed scroll frame;
a first annular seal groove formed in one of said back surface of said fixed scroll plate and said attaching surface of said fixed scroll frame;
a first annular seal element at least partially disposed within said first seal groove and sealingly contacting against the other of said back surface and said attaching surface to define a first chamber intermediate said fixed scroll plate and said fixed scroll frame;
a port extending through said fixed scroll plate and being in fluid communication with said first chamber, whereby pressurized fluid may be introduced into said first chamber through said port;
a plurality of connecting pins each having first ends received into axial holes formed in said drive plate and opening onto said mounting surface, and second ends received within axial holes in said orbiting scroll plate and opening onto said hind surface, at least one of said first and second ends being slidably received within their corresponding holes to permit axial movement of said orbiting scroll plate relative said drive plate;
a second annular seal groove formed in one of said hind surface of said orbiting scroll plate and said mounting surface of said drive plate;
a second annular seal element at least partially disposed within said second seal groove and sealingly contacting against the other of said hind surface and said mounting surface to define a second chamber intermediate said orbiting scroll plate and said drive plate; and
an opening extending through said orbiting scroll plate to provide fluid communication with said second chamber, whereby pressurized fluid may be introduced into said second chamber.

17. The floating scroll assembly of claim 16 in combination with a hermetic scroll compressor apparatus including a scroll compressor mechanism and an oil sump within a hermetically sealed housing at discharge pressure, and further comprising:
means for delivering oil at discharge pressure from said oil sump to said second chamber through said opening through said orbiting scroll plate.

18. The floating scroll assembly of claim 16 in which:
said first seal element is unattachedly retained within said first seal groove and telescopingly extends axially from said first seal groove toward said attaching surface of said fixed scroll frame to slidingly seal thereagainst; and
said second seal element is unattachedly retained within said second seal groove and telescopingly extends axially from said second seal groove toward said mounting surface of said orbiting scroll plate to slidingly seal thereagainst.

19. The floating scroll assembly of claim 18 in which:
said first chamber and said second chamber are exposed to substantially equal areas on said back surface of said fixed scroll plate and said hind surface of said orbiting scroll plate, respectively, thereby resulting in substantially equal compliance forces applied to said fixed scroll plate and said orbiting scroll plate.

20. A scroll-type compressor for compressing refrigerant fluid, comprising:

a hermetically sealed housing including therein a discharge pressure chamber at discharge pressure and a suction pressure chamber at suction pressure;

an oil sump within said discharge pressure chamber;

a fixed scroll frame including an attaching surface;

a fixed scroll plate including a back surface and a front surface having an involute wrap thereon;

first coupling means for coupling said fixed scroll plate to said fixed scroll frame with said back surface facing said attaching surface, said first coupling means permitting axial movement of said fixed scroll plate and said fixed scroll frame relative one another;

first seal means defining a substantially sealed first chamber intermediate said back surface and said attaching surface for causing axial separation of said fixed scroll plate and said fixed scroll frame relative one another in response to introduction of a pressurized fluid in said first chamber;

passage means formed in said fixed scroll plate for introducing refrigerant fluid at discharge pressure into said first chamber;

a drive plate including a mounting surface;

an orbiting scroll plate including a hind surface and a face surface having an involute wrap thereon, said involute wrap of said fixed scroll plate and said involute wrap of said orbiting scroll plate being operably intermeshed axially intermediate said fixed scroll frame and said drive plate;

second coupling means for coupling said orbiting scroll plate to said drive plate with said hind surface facing said mounting surface, said second coupling means permitting axial movement of said orbiting scroll plate and said drive plate relative one another;

second seal means defining a substantially sealed second chamber intermediate said hind surface and said mounting surface for causing axial separation of said orbiting scroll plate and said drive plate relative one another in response to introduction of a pressurized fluid in said second chamber; and means for introducing oil at discharge pressure from said oil sump into said second chamber.

* * * * *